US008726577B2

(12) United States Patent
Whiting

(10) Patent No.: US 8,726,577 B2
(45) Date of Patent: May 20, 2014

(54) INTEGRATED SAFETY RAIL PROTECTION SYSTEM

(75) Inventor: Richard J. Whiting, Flower Mound, TX (US)

(73) Assignee: SafePro, L.P., Dallas, TX (US)

( * ) Notice: Subject to any disclaimer, the term of this patent is extended or adjusted under 35 U.S.C. 154(b) by 491 days.

(21) Appl. No.: 12/825,265

(22) Filed: Jun. 28, 2010

(65) Prior Publication Data

US 2011/0017967 A1 Jan. 27, 2011

Related U.S. Application Data

(60) Provisional application No. 61/269,593, filed on Jun. 26, 2009.

(51) Int. Cl.
*E02D 29/14* (2006.01)

(52) U.S. Cl.
USPC ..... 52/20; 256/25; 256/26; 256/59

(58) Field of Classification Search
USPC ..... 256/25–27, 38, 39, 59; 52/19, 20, 174, 52/184
See application file for complete search history.

(56) References Cited

U.S. PATENT DOCUMENTS

| | | | |
|---|---|---|---|
| 351,244 | A | 10/1886 | Baines |
| 385,531 | A | 7/1888 | Shrader |
| 473,128 | A | 4/1892 | Rankin |
| D27,021 | S | 5/1897 | Smith |
| 766,185 | A | 8/1904 | Harold |
| 877,076 | A | 1/1908 | Hageman |
| 2,240,689 | A | 5/1941 | Denton |
| 2,538,980 | A | 1/1951 | Payne |
| 2,669,434 | A | 2/1954 | White |
| 2,776,757 | A | 1/1957 | Schoenlaub |
| 2,950,015 | A | 8/1960 | Pataky |
| 3,111,303 | A | 11/1963 | Olson |

(Continued)

FOREIGN PATENT DOCUMENTS

| | | | |
|---|---|---|---|
| DE | 3423184 | A1 | 1/1986 |
| FR | 2897624 | A1 | 8/2007 |
| WO | WO-9733062 | A1 | 9/1997 |
| WO | WO-2006083953 | A2 | 8/2006 |

OTHER PUBLICATIONS

International Search Report and Written Opinion in PCT Patent Application No. PCT/US09/53015, dated Jan. 7, 2010 (14 pages).

(Continued)

*Primary Examiner* — Gregory Binda
*Assistant Examiner* — Nahid Amiri
(74) *Attorney, Agent, or Firm* — Gardere Wynne Sewell LLP

(57) ABSTRACT

A unique safety rail system with integrated hand-grip projections, structures for affixing the system for the safe and easy egress and ingress through an opening, such as roof or floor access holes. The safety rail system is designed to reduce the risk of falls while ascending or descending a ladder through an access hole while providing additional protection and prevention of personnel accidentally falling through an open access. A self-closing gravity gate may be provided acting as additional hand-grip, support, and barrier. This system may employ methods of construction and assembly using a unique continuous tubular structure of converging vertical and angular upright post with horizontal upper safety rail, forward protruding hand-grip and opposing directionally horizontal lower attachment support means reducing lateral motion and allows efficient installation for new construction or retro fitting of existing openings.

32 Claims, 8 Drawing Sheets

(56) References Cited

U.S. PATENT DOCUMENTS

| | | | | |
|---|---|---|---|---|
| 3,201,160 | A | 8/1965 | Lewin | |
| 3,205,351 | A | 9/1965 | Walker | |
| 3,222,509 | A | 12/1965 | Thedford | |
| 3,285,576 | A | 11/1966 | Clark | |
| 3,350,819 | A | 11/1967 | Polidor | |
| 3,352,541 | A | 11/1967 | Thom | |
| 3,486,739 | A | 12/1969 | Nelson et al. | |
| 3,719,386 | A | 3/1973 | Puckett et al. | |
| 3,832,804 | A | 9/1974 | Goldsmith | |
| 3,844,087 | A | 10/1974 | Schultz et al. | |
| 3,940,896 | A | 3/1976 | Steel | |
| 4,037,788 | A | 7/1977 | Riley | |
| 4,114,330 | A | 9/1978 | Sukolics | |
| 4,118,044 | A | 10/1978 | Celms | |
| 4,169,623 | A | 10/1979 | Smith | |
| 4,357,982 | A | 11/1982 | Yamada et al. | |
| 4,371,148 | A * | 2/1983 | Harden | 256/26 |
| 4,380,327 | A | 4/1983 | Fish | |
| 4,520,898 | A | 6/1985 | Allemane | |
| 4,546,855 | A | 10/1985 | Lyons | |
| 4,576,364 | A | 3/1986 | O'Fearna | |
| 4,589,239 | A | 5/1986 | Cummings | |
| 4,652,862 | A | 3/1987 | Verslycken | |
| 4,682,454 | A | 7/1987 | Simpson et al. | |
| 4,682,762 | A | 7/1987 | Lekavich | |
| 4,703,596 | A | 11/1987 | Sandow | |
| 4,750,302 | A | 6/1988 | Bechtold | |
| 4,763,937 | A | 8/1988 | Sittnick, Jr. et al. | |
| 4,796,404 | A | 1/1989 | Butler | |
| 4,833,838 | A | 5/1989 | Van Dame | |
| 4,854,076 | A | 8/1989 | Sieben et al. | |
| 4,933,615 | A | 6/1990 | Furuya et al. | |
| 4,993,757 | A | 2/1991 | Corzine | |
| RE33,720 | E | 10/1991 | Cummings | |
| 5,102,103 | A | 4/1992 | Putnam | |
| 5,152,508 | A | 10/1992 | Fish | |
| 5,291,705 | A | 3/1994 | Dickerson | |
| 5,313,748 | A | 5/1994 | Hughes, Jr. | |
| D354,817 | S | 1/1995 | Kovacs et al. | |
| 5,394,664 | A | 3/1995 | Nowell | |
| 5,496,016 | A | 3/1996 | Parisien | |
| 5,502,934 | A | 4/1996 | Coyne et al. | |
| 5,509,250 | A | 4/1996 | Jensen et al. | |
| 5,524,401 | A | 6/1996 | Ishikawa et al. | |
| 5,553,833 | A | 9/1996 | Bohen | |
| 5,664,769 | A | 9/1997 | Sadinsky et al. | |
| 5,683,074 | A | 11/1997 | Purvis et al. | |
| 5,715,634 | A | 2/1998 | Schultz | |
| 5,802,783 | A | 9/1998 | Bayha | |
| 5,806,255 | A | 9/1998 | Verby et al. | |
| 5,842,685 | A | 12/1998 | Purvis et al. | |
| 5,862,645 | A | 1/1999 | Lee | |
| D410,289 | S | 5/1999 | Howard et al. | |
| 5,941,024 | A * | 8/1999 | Journault | 52/20 |
| 5,983,593 | A | 11/1999 | Carbary et al. | |
| 6,061,993 | A | 5/2000 | Bendixen et al. | |
| 6,095,283 | A | 8/2000 | Ellis | |
| 6,138,433 | A | 10/2000 | Ridge | |
| 6,167,659 | B1 | 1/2001 | Swindell, III | |
| 6,199,330 | B1 | 3/2001 | Cobb | |
| 6,253,530 | B1 | 7/2001 | Price et al. | |
| 6,260,323 | B1 | 7/2001 | Hockey | |
| 6,263,624 | B1 | 7/2001 | Hoy et al. | |
| 6,272,800 | B1 | 8/2001 | Phinney et al. | |
| 6,293,051 | B1 | 9/2001 | Matye | |
| 6,308,486 | B1 | 10/2001 | Medland | |
| 6,347,685 | B1 | 2/2002 | Ellis | |
| 6,354,046 | B1 | 3/2002 | Swearingen | |
| 6,375,164 | B1 | 4/2002 | Siegler et al. | |
| 6,467,118 | B2 | 10/2002 | Dumlao et al. | |
| 6,467,230 | B1 | 10/2002 | Perkins et al. | |
| 6,477,972 | B2 | 11/2002 | Perkins | |
| 6,561,373 | B1 | 5/2003 | Chapin | |
| 6,572,182 | B2 | 6/2003 | Lamparter et al. | |
| 6,604,329 | B2 | 8/2003 | Hoy et al. | |
| 6,604,332 | B1 | 8/2003 | Hughes et al. | |
| 6,607,053 | B1 | 8/2003 | Warren | |
| 6,619,428 | B2 | 9/2003 | Ellis | |
| 6,681,528 | B1 | 1/2004 | Profeta et al. | |
| 6,688,046 | B2 * | 2/2004 | Perkins | 52/19 |
| 6,699,558 | B1 | 3/2004 | Milburn | |
| 6,739,104 | B2 | 5/2004 | Tokonabe et al. | |
| 6,739,583 | B2 | 5/2004 | Ryon | |
| 6,857,622 | B2 | 2/2005 | Okita | |
| 6,892,751 | B2 | 5/2005 | Sanders | |
| 6,931,793 | B2 * | 8/2005 | Joyce et al. | 52/20 |
| 6,952,996 | B2 | 10/2005 | Sisk et al. | |
| 7,000,557 | B1 | 2/2006 | Forbes et al. | |
| 7,055,440 | B2 | 6/2006 | Sisk | |
| 7,082,726 | B2 | 8/2006 | Prenn et al. | |
| 7,134,254 | B1 | 11/2006 | Van Gelder | |
| 7,300,037 | B2 | 11/2007 | Beirne, Jr. et al. | |
| 7,338,033 | B2 | 3/2008 | Anson et al. | |
| 7,513,014 | B2 * | 4/2009 | Lin | 16/374 |
| 7,516,575 | B2 * | 4/2009 | Cuccurullo | 52/20 |
| 7,638,962 | B2 | 12/2009 | Cardwell | |
| 2004/0104382 | A1 | 6/2004 | Collins et al. | |
| 2004/0262314 | A1 | 12/2004 | Weatherhead et al. | |
| 2005/0115173 | A1 | 6/2005 | Joyce et al. | |
| 2005/0166458 | A1 | 8/2005 | McKenzie et al. | |
| 2006/0102886 | A1 | 5/2006 | Rosenbaum | |
| 2006/0202815 | A1 | 9/2006 | John | |
| 2007/0241709 | A1 | 10/2007 | Cardwell | |
| 2008/0060874 | A1 | 3/2008 | Lair | |

OTHER PUBLICATIONS

Roof Accessories product brochure by Activar Inc., copyright 2007 (4 pages).

440 Fence Company, Inc., product advertisement 2006 Brochure (1 page).

BlueWater Manufacturing, Grab-Bar Roof Hatch Fall Protection product advertisement, www.bluewater-mfg.com/grab-bar.htm; copyright 2005 (1 page).

PS Doors Safety Product Group, Hatchsafe Roof Hatch Railing System, copyright 2009 (2 pages).

PS Doors Safety Product Group, Hatchgrip, www.psdoors.com; copyright 2009 (1 page).

Roofing Contractor Magazine, Jun. 2009, p. 10 "Bil-Guard Hatch Rail System" and the Classifieds page "The Safety Rail Source" (3 pages).

Photo taken at Safety 2009—ASSE tradeshow in San Antonio, Texas, on Jun. 29, 2009; product by LadderTech, LLC; www.ladderport.com (1 page).

LadderPort Jan. 2009 catalog, "Your Roof Access & Ladder Safety Source," (12 pages).

Garlock Safety Systems, Railguard 200 advertisement, www.railguard.net/roof-hatchsafety.asp; copyright 2009 (2 pages).

U.S. Appl. No. 61/318,284 entitled "Automatic Retractable Hatch Guard:" Inventor Michael Cardwell, filed Mar. 27, 2010.

Engineered Fall Protection and Confined Space Systems, "Roof Hatch Fall Protection," Datasheet [online]. WS Safety Technologies, 2008. Internet address: http://www.wssafety.com/roof-hatch-fall-protection.html, (1 page).

International Search Report and Written Opinion in PCT Patent Application No. PCT/US09/040250, dated Sep. 17, 2010 (10 pages).

"Stairways and Ladders" a Guide to OSHA Rules, U.S. Department of Labor, OSHA 3124-12R, 2003 (15 pages).

"Open Roof Hatches Should Be Protected; Grab Bars Not Required at Hatch Exits," OSHA Standard Interpretations, Standard No. 1910.27(c)(7); 1910.23; Jul. 12, 2000 (2 pages).

* cited by examiner

INTEGRATED SAFETY RAIL PROTECTION SYSTEM

CROSS-REFERENCE TO RELATED APPLICATIONS

Pursuant to 35 U.S.C. §119(e), this application claims priority from and the benefit of and hereby incorporates by reference for all purposes, U.S. Provisional Application No. 61/269,593, filed Jun. 26, 2009, entitled "Integrated Safety Rail Protection System," naming Richard J. Whiting as the inventor.

TECHNICAL FIELD

This invention relates to roof and floor safety protection rail systems and ergonomical methods of safe ingress and egress to reduce or eliminate hazards to personnel, including protection of people above and below a scuttle hatch, access ports, skylights and elevated decks.

BACKGROUND

While it is of the most importance for personnel to egress and ingress through an access portal in a safe manner it is also important for building owners and proprietors to reduce loss and liability. The act of climbing to or from an elevated height to egress or ingress a roof scuttle hatch, floor opening, skylight, or other elevated portal is often a very dangerous undertaking. Numerous hazards can cause an employee to trip, slip, or fall. In fact records with U.S. Department of Labor Occupational Safety & Health Administration (OSHA) show tragic accidents that often result in death. Occupational fatalities caused by falls remain a serious public health problem throughout the United States. According to the United States Department of Labor News report of Oct. 31, 2007 reported, in the Washington, D.C. metropolitan area, falls to a lower level was the most frequent type of fatal occupational injury; this was also true in New York, Chicago, Los Angeles, Miami, and Boston.

Personnel having a need to ascend or descend through an access portal, which usually requires a climb to an unsafe height above a floor or deck, face numerous safety concerns. For example, the location of an access portal is most often in a darkened and out of the way location within a building subsequently making it very difficult for personnel to see during exit. Further, due to the often dark indoor lighting near the portal, which is often above a drop ceiling, ascending personnel that have become accustomed to low light levels may be suddenly exposed the bright sunlight making if difficult to visualize a good secure grab hold. Moreover, while personnel are descending or exiting from the bright sunlight of the outdoors into the dark area adjacent to the portal, they may be suddenly exposed to low light levels further impairing their vision to secure a good grab hold while descending.

Flat roofed buildings, roadways, catwalks, attics, skylights, and other similar structures, commonly include portals, such as a roof portal, manhole, or other similar structure, with or without a hatch or lid, for ingress and egress to the roof, roadway, catwalk, etc. For example, commercial warehouses or other flat roofed buildings, commonly include one or more hatch-like roof portals for ingress and egress to the roof. Many times, these roof portals are located in positions away from walls or other supporting structures, thereby, necessitating the user to make steep climbs over high elevations for ingress and egress to the roof. With high elevations and steep climbs the risk of harm to a user from a fall is already great; however, when factoring in a user's fear of heights, vertigo, or other emotional and/or physiological responses, the risk of harm to the user from falling greatly increases. Moreover, additional factors, such as transporting equipment through the portals, may further increase the risk of harm to the user.

A problem existing with current portals, such as a roof or scuttle hatch, without a safety rail and or grab holds is that personnel have to precariously perch on the top rung of a ladder with the only hand hold approximately 1 foot above their feet on the top of the portal's curb in order to exit or enter the portal, which is a rather difficult and dangerous balancing act that subjects the personnel to increased risk of harm.

Additional problems exists while ascending or descending, such as personnel often have to dangerously reach backwards with one hand while awkwardly holding on with the other hand to the portal's curb or top ladder rung to open or close an often heavy portal/hatch cover, which may or may not have worn or damaged spring load assist or latches, and may be subject to constant or changing wind loads while being opened or closed.

SUMMARY

Embodiments of the integrated safety rail protection system may utilize an ergonomic and structurally rigid railing system, which may include a gate, that provides the user with multiple ergonomic projections for hand and/or foot support while ingressing or egressng through a portal, such as a roof portal or other portal opening.

In accordance with one aspect of the present invention, a railing system that may be positioned on a roof adjacent to a roof opening portal having an upwardly lifting lid is provided and includes a first side rail with a first side gate projection, a second side rail with a second side gate projection; and a hinged gate operable to open outwardly.

In yet another embodiment of the integrated safety rail protection system, the railing system further comprises a back rail positioned substantially between the first side rail and the second side rail.

In yet another embodiment of the integrated safety rail protection system, the hinged gate interfaces with the first side gate projection.

In yet another embodiment of the integrated safety rail protection system, the hinged gate may interface with the second side gate projection.

In yet another embodiment of the integrated safety rail protection system, the railing system further comprises a hinge structure positioned adjacent to the interface of the hinged gate and the first side gate projection.

In yet another embodiment of the integrated safety rail protection system, the railing system further comprises a biasing structure positioned adjacent to the interface of the hinged gate and the first side gate projection.

In yet another embodiment of the integrated safety rail protection system, the railing system further comprises a latching structure positioned adjacent to the interface of the hinged gate and the second side gate projection.

In yet another embodiment of the integrated safety rail protection system, the first side rail further comprises a first side hand-grip projection.

In yet another embodiment of the integrated safety rail protection system, the second side rail further comprises a second side hand-grip projection.

In yet another embodiment of the integrated safety rail protection system, the rails system is at least partially knurled.

In yet another embodiment of the integrated safety rail protection system, the first side rail further comprises a cross rail member.

In yet another embodiment of the integrated safety rail protection system, the second side rail further comprises a cross rail member.

In yet another embodiment of the integrated safety rail protection system, the first side rail is formed from a single continuous tube.

In yet another embodiment of the integrated safety rail protection system, the second side rail is formed from a single continuous tube.

In yet another embodiment of the integrated safety rail protection system, the hinged gate is formed from a single continuous tube.

In yet another embodiment of the integrated safety rail protection system, the railing system further comprises a second hinged gate.

In yet another embodiment of the integrated safety rail protection system, the first hinged gate interfaces with the first side rail and the second hinged gate interfaces with the second side rail.

In yet another embodiment of the integrated safety rail protection system, the first hinged gate interfaces with the second hinged gate at a position between said first side rail and said second side rail.

In yet another embodiment of the integrated safety rail protection system, the railing system further comprises a latching structure positioned adjacent to at least one of the interface of said first hinged gate and said second hinged gate.

In yet another embodiment of the integrated safety rail protection system, the railing system further comprises a hinge structure positioned adjacent to the interface of the second hinged gate and the second side gate projection.

In yet another embodiment of the integrated safety rail protection system, the railing system further comprises a biasing structure positioned adjacent to the interface of the second hinged gate and the second side gate projection.

DETAILED DESCRIPTION

Figure 1:
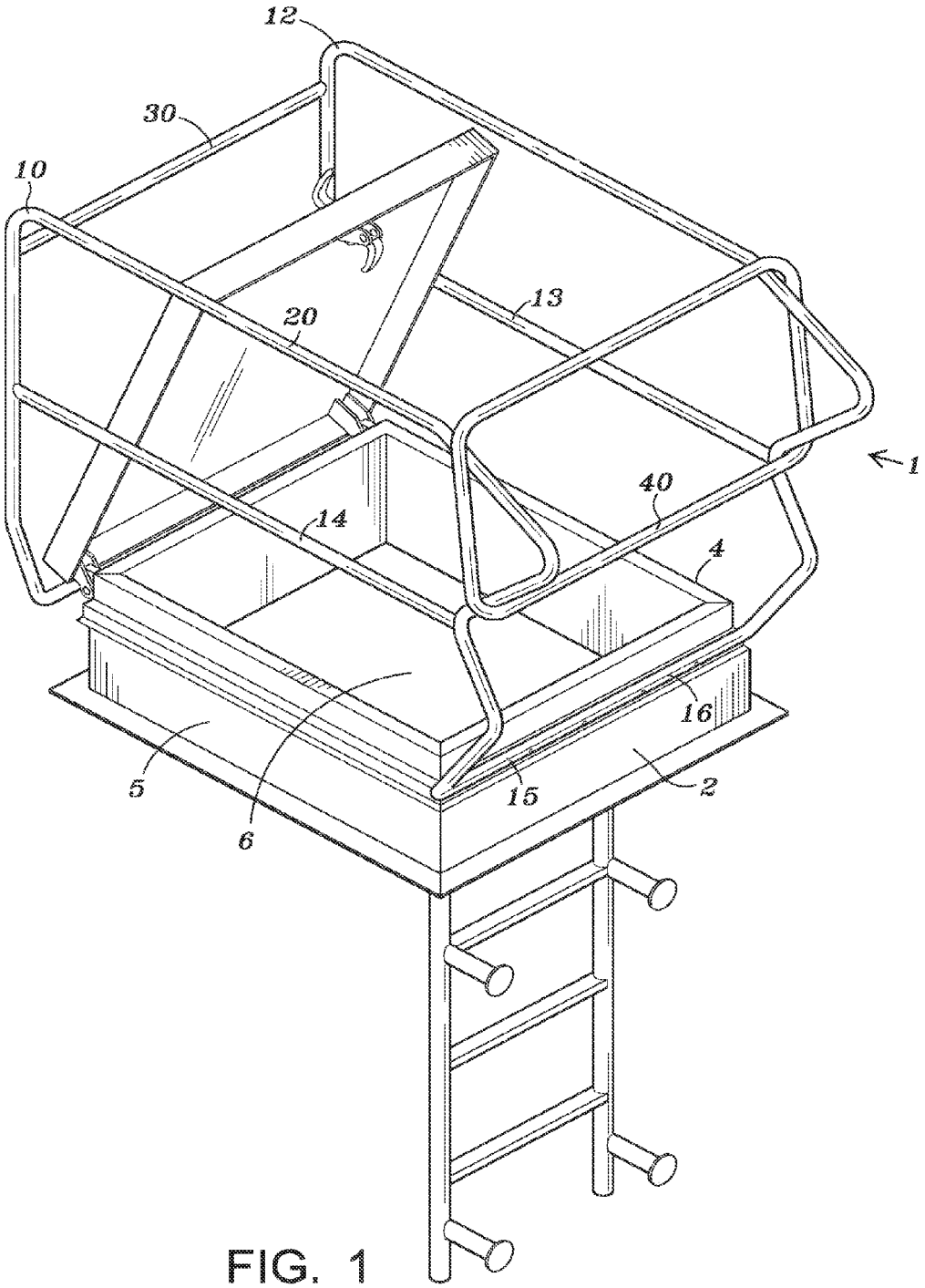
FIG. 1 is an isometric view showing one embodiment of the integrated safety rail protection system mounted onto a portal.

It should be understood at the outset that although an exemplary implementation of the present invention is illustrated below, the present invention may be implemented using any number of techniques, materials, designs, and configurations whether currently known or in existence. The present invention should in no way be limited to the exemplary implementations, drawings, and techniques illustrated below, including the exemplary designs and implementations illustrated and described herein.

In the description which follows, like parts are marked throughout the specification and drawings with the same reference numerals, respectively. The drawings are not necessarily to scale and certain features may be shown exaggerated in scale or in somewhat schematic form in the interest of clarity and conciseness.

Referring initially to FIGS. 1, 2, 4, 5, 6, and 12, an embodiment of the integrated safety rail protection system 1 is provided and includes, in one form, a first substantially vertical side rail 10, a second substantially vertical side rail 12, and a hinged gate 40. It should be noted that the second side rail 12 operates and functions in substantially the same manner as the first side rail 10, as further described herein. In other embodiments, a side rail 10 may have a cross rail member 14 extending longitudinally or diagonally within a plane passing through the side rail. In yet other embodiments, a back rail member 30 may extend between the first side rail 10 and the second side rail 12, at a location generally adjacent to the opposite end from the gate portion of the integrated safety rail protection system 1, but in other embodiments the back rail member 30 may extend between the first side rail 10 and the second side rail 12, at a location anywhere suitable along the length of the side rails (10 and 12).

Figure 2:
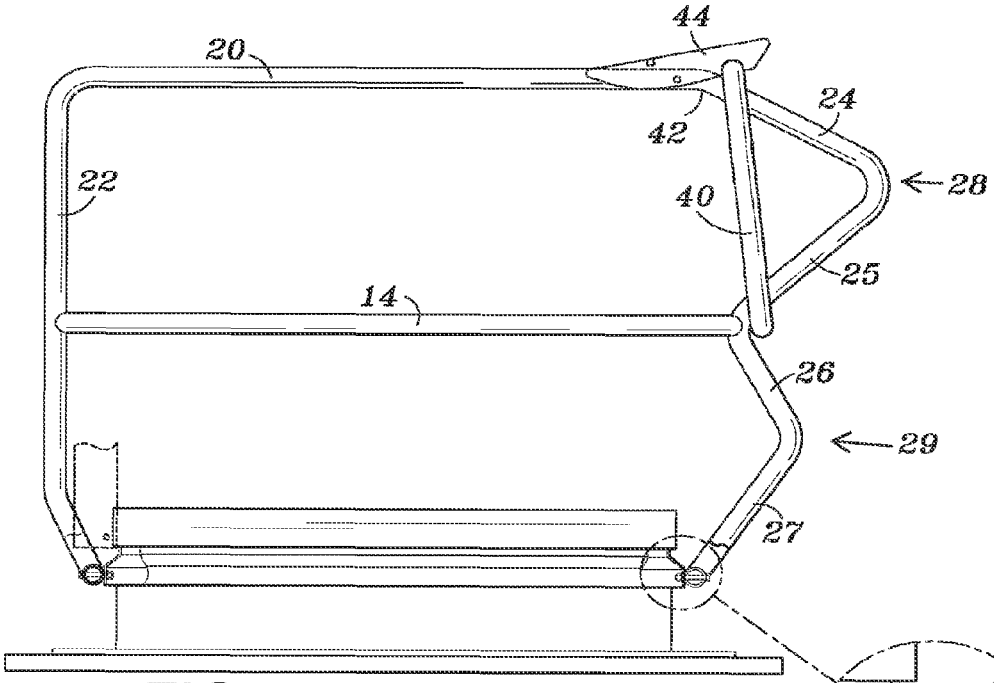
FIG. 2 is a side view showing one embodiment of the integrated safety rail protection system mounted onto a portal and having a latch structure.
Figure 3:
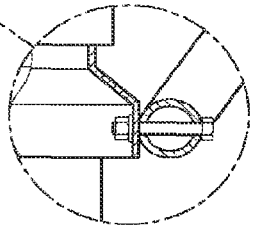
FIG. 3 is a side view showing one embodiment of the integrated safety rail protection system, wherein the rail system is mounted to the portal using fasteners.
Figure 4:
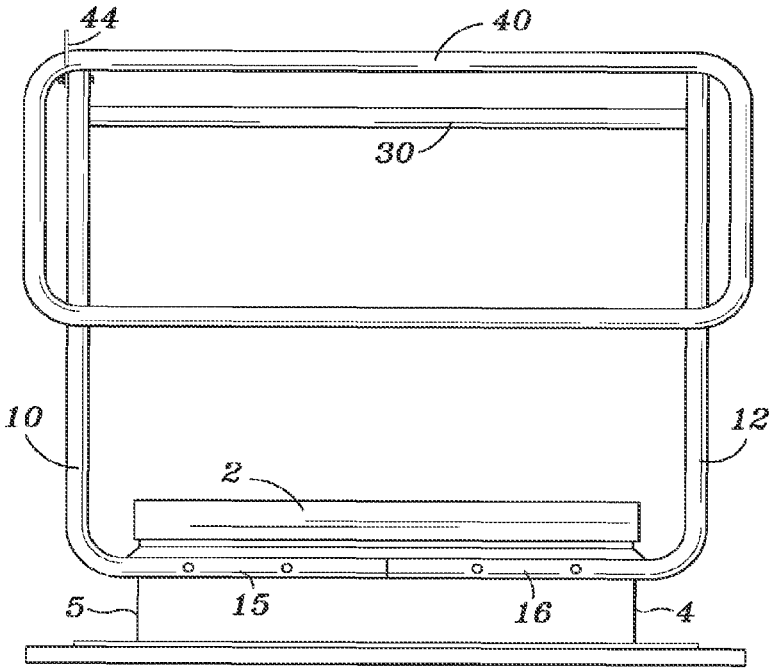
FIG. 4 is a front view showing one embodiment of the integrated safety rail protection system mounted onto a portal and having a latch structure.
Figure 7:
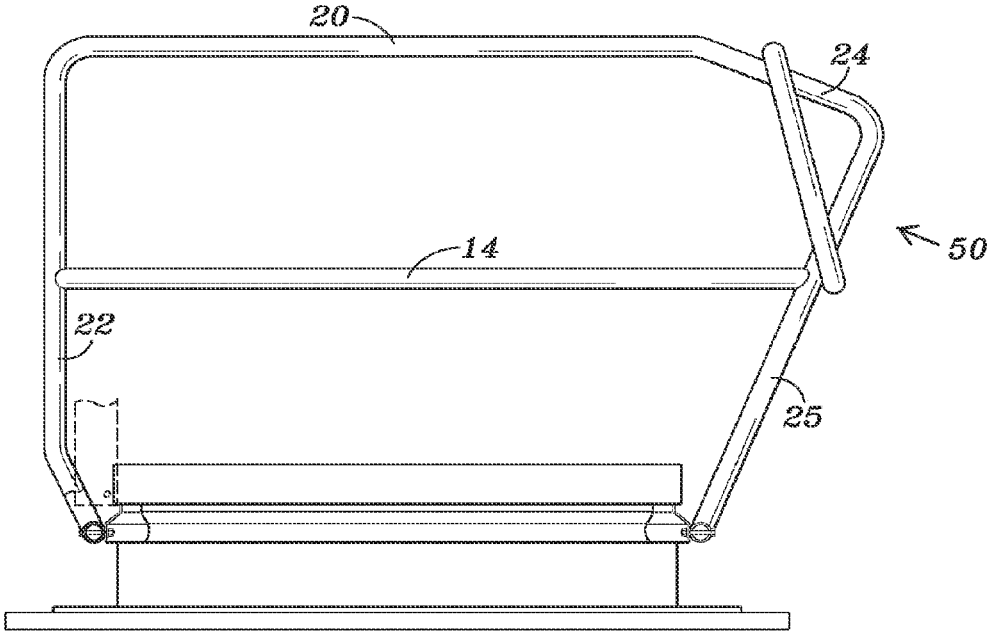
FIG. 7 is a side view showing one embodiment of the integrated safety rail protection system mounted onto a portal with an alternative hand grip projection.

Referring to FIGS. 1 and 2, in other embodiments, a side rail 10 may have a generally horizontal top rail 20 for structural strength and to provide the user with a gripping surface for aiding in ingress and egress through a portal 6, such as a roof portal. The side rail 10 may further have a generally vertical down rail 22 for structural strength and to provide the user with a gripping surface for aiding in ingress and egress through the portal 6. In yet another embodiment, the side rail 10 may further have a side gate projection 28 for structural strength, to interface with the hinged gate 40, and to provide the user with an ergonomic gripping surface for aiding in ingress and egress through the portal 6. In yet another embodiment, the side rail 10 may further have a side hand-grip projection 29 for structural strength and to provide the user with an ergonomic gripping surface for aiding in ingress and egress through the portal 6. In yet other embodiments, the side gate projection 28 and the side hand-grip projection 29 may have the form of straight and curved lengths with arcuate bends of varying angles. For example, in some embodiments, as seen in FIG. 2, the front portion of the side rail 10, may have a first segment 24, extending from the top rail 20 at a downward angle of about 25-degrees from the top rail 20, transitioning to a second segment 25, extending from the first segment 24 at downward angle of about 135-degrees from a line substantially parallel to the top rail 20, wherein the combination of the first segment 24 and second segment 25 form the front side gate projection 28, transitioning to a third segment 26, extending downward from the second segment 25 at a downward angle of about 60-degrees from a line substantially parallel to the top rail 20, transitioning to a fourth segment 27, extending from the third segment 26 at a downward angle of about 125-degrees from a line substantially parallel to the top rail 20, wherein the combination of the third segment 26 and fourth segment 27 form the front hand-grip projection 29. Alternatively, in other embodiments as illustrated in FIG. 7, and described in more detail below, the first segment 24 may transition to a second segment 25 at a downward angle of about 120-degrees from a line substantially parallel to the top rail 20, wherein the combination of the first segment 24 and second segment 25 form the front side gate projection 50, and wherein the second segment 25 extends downward to the base of the side rail 10. The embodiments of the front side gate projections and hand-grip projections are not limited to the angles described, but as one of ordinary skill in the art would recognize, can be composed of any number of segments at any number of angles to achieve one or more ergonomic or desired grab holds or hand-grips for a user.

In yet other embodiments, the side rail 10 may be made from a single length of metallic tubing that is bent to form a one piece side rail 10 to provide the added benefit, in certain embodiments, of ease of manufacture, ease of assembly, structural strength, and no loosening of joint fittings. However, in yet other embodiments, the side rail 10 may be crafted from multiple pieces of tubing or other suitable material fastened together, via bolts, welds, screws, or other suitable means. Additionally, in other embodiments the side rail 10 may further include a cross rail member 14 to aid in structural strength and provide the user with an additional gripping surface for aiding in ingress and egress through the portal 6.

Referring to FIGS. 1, 3, 4, 5, 11, and 12, in other embodiments, the side rail 10 may have a front mounting projection 15 for fastening, via screws, bolts, welds, or other suitable means, the rail 10 to the front flange 2, and side rail 10 may have a rear mounting projection 18 for fastening, via screws, bolts, welds, or other suitable means, the rail 10 to the rear flange 3 of the portal 6, although in other embodiments, the front mounting projection 15 and the rear mounting projection 18 may be positioned for mounting the side rail 10 to the side flange 5. However, fastening to the front flange 2 and rear flange 3 of a portal 6 provides the benefit of strengthening the capability of the side rail 10 to withstand side-to-side and front-to-back forces that might cause railing systems to fail or otherwise separate from their mountings under the stress of a user's weight.

Figure 10:
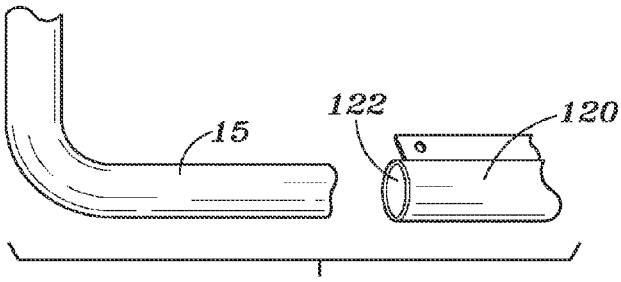
FIG. 10 is an exploded front view showing one embodiment of a rail mounting system having a hollow mounting structure.
Figure 11:
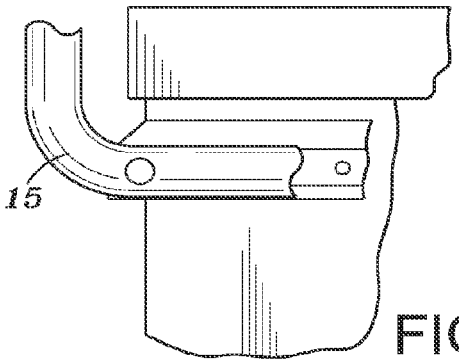
FIG. 11 is a front view showing one embodiment of a rail mounting system that mounts the integrated safety rail protection system to a portal using fasteners, such as screws or bolts.

Referring to FIG. 10, in other embodiments, a mounting projection 15 may be mounted adjacent to the portal 6 using a mounting structure 120 having an opening 122 for receiving the mounting projection 15, which may be fastened to the mounting structure 120, via screws, bolts, welds, or other suitable means, and which the mounting structure 120 itself is mounted adjacent to the portal 6, via screws, bolts, welds, or other suitable means. The opening 122 of the mounting structure 120 may be a hollow or tubularly shaped opening, or other suitable opening for receiving the mounting projection 15. For example, in one embodiment, the mounting structure 120 may be a hollow metal tube with protruding surfaces for attaching the mounting structure 120 to the front flange 2 or rear flange 3 of the portal 6, wherein a mounting projection 15 may be inserted into the hollow portion of the metal tube and fastened therein using welds, bolts, screws, or other suitable means. The mounting structure 120 may be made from metal, fiberglass, composite, or other suitable materials, and allow for quick and easy attachment adjacent to the portal 6 or ground surface, allow for flexibility in fitting the railing system to various sized portals 6, and allow for increased strength and rigidity by providing more contact surface to the mounting projection 15 than might be accomplished using traditional direct fastening, via screws, bolts, or welds, of the mounting projection 15 adjacent to the portal 6.

Figure 5:
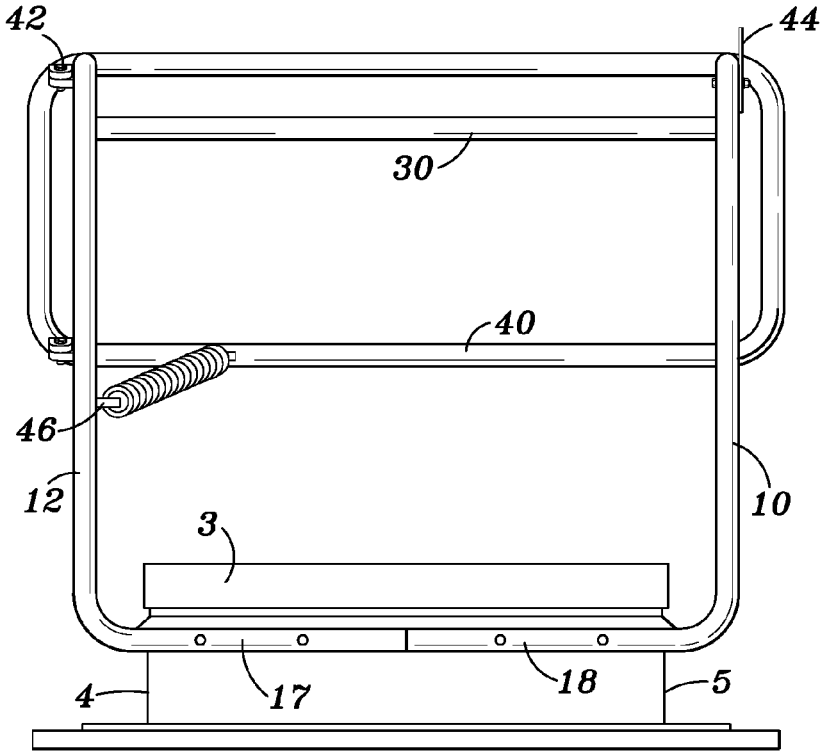
FIG. 5 is a back view showing one embodiment of the integrated safety rail protection system mounted onto a portal and having a hinge structure, biasing structure, and a latch structure.
Figure 6:
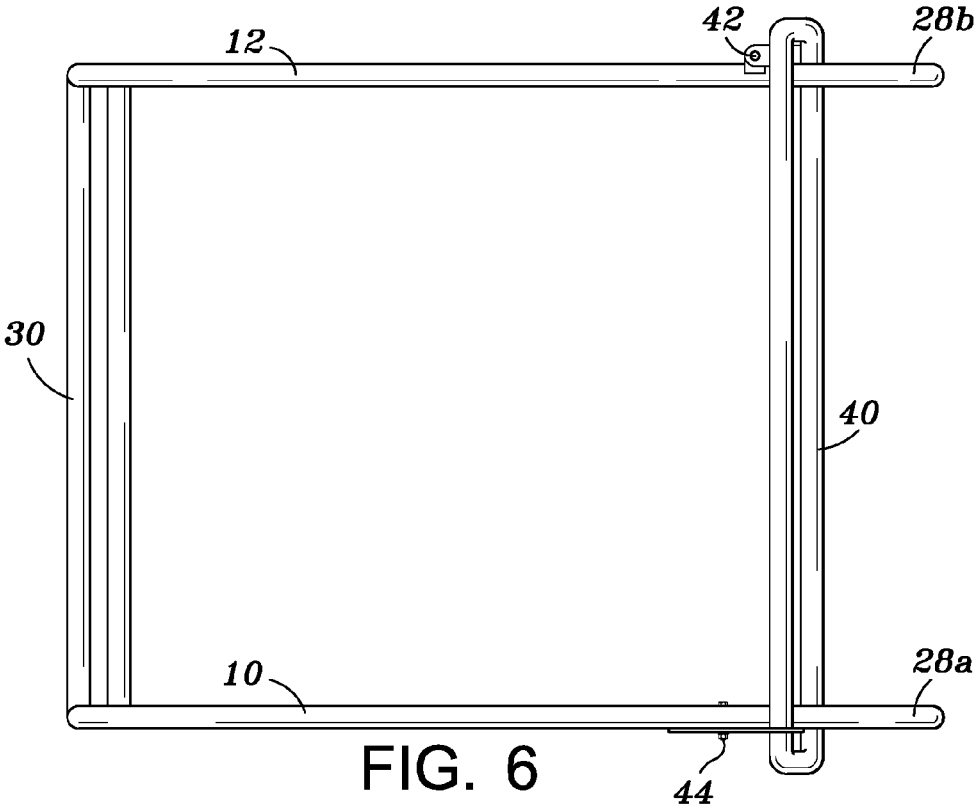
FIG. 6 is a top view showing one embodiment of the integrated safety rail protection system.
Figure 12:
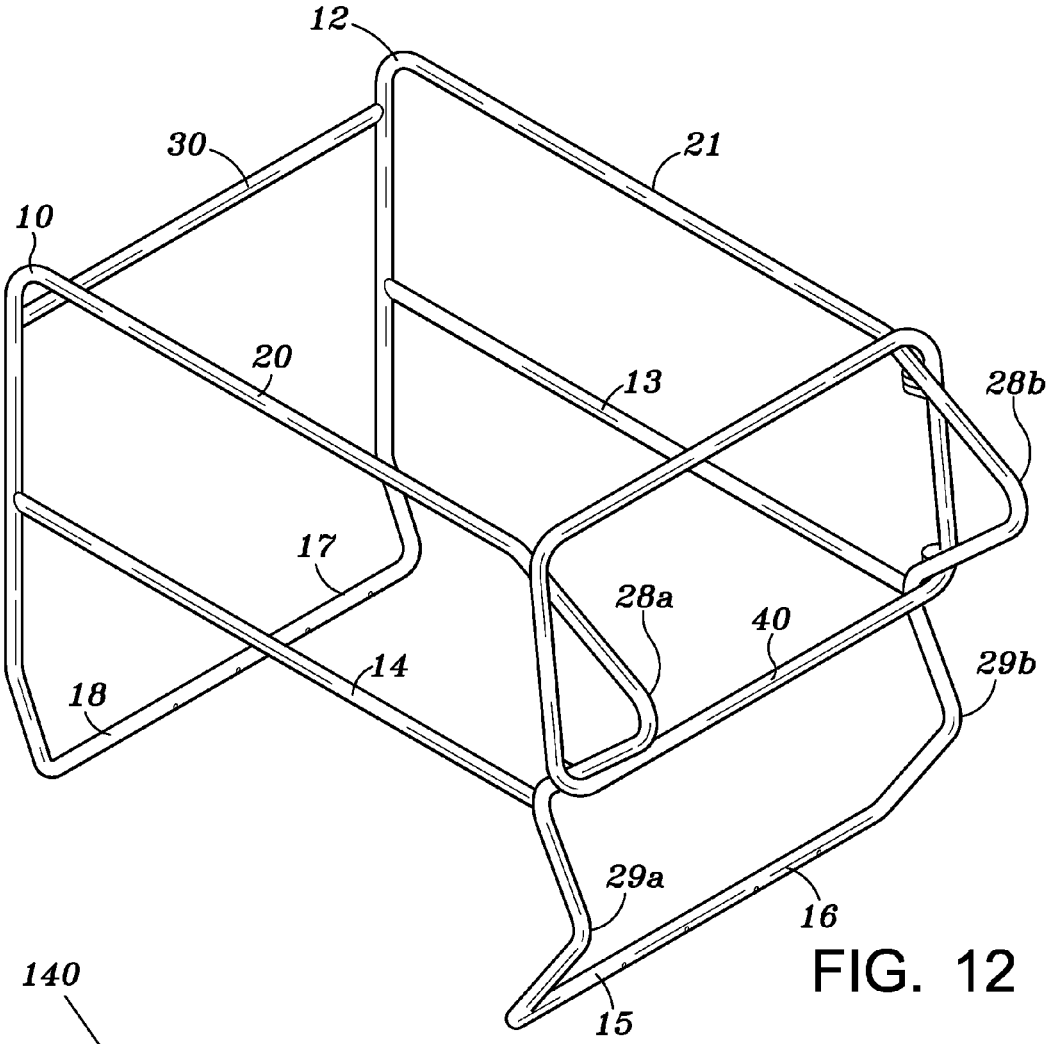
FIG. 12 is an isometric view showing one embodiment of a rail mounting system prior to installation of the rail mounting system.
Figure 13:
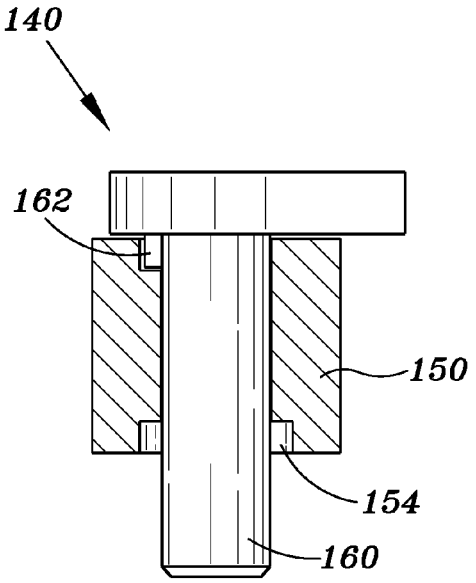
FIG. 13 is a side cutaway view of one embodiment of a pinchless hinge structure.
Figure 14:
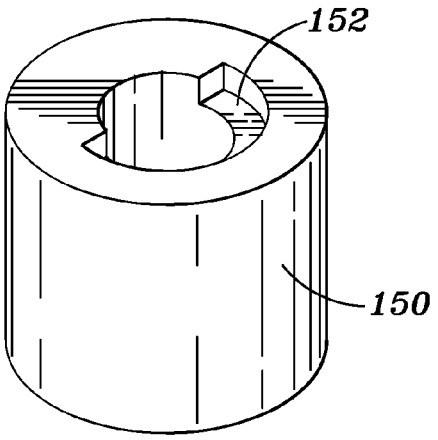
FIG. 14 is a top isometric view of a housing of a pinchless hinge structure having a partial recess in one end of the housing.
Figure 15:
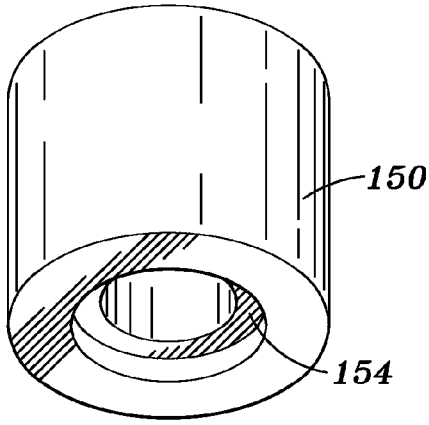
FIG. 15 is a bottom isometric view of a housing of a pinchless hinge structure having a full recess in one end of the housing.

Referring to FIGS. 2, 4, 5, 6, 7, and 12, in one embodiment, the hinged gate 40 is positioned to rest adjacent to the side gate projection 28*a* of the first side rail 10 and the side gate projection 28*b* of the second side rail 12 and operable to open outwardly from the portal 6 and return to its resting or closed position (i.e., interfaced with both the side gate projection 28*a* of the first side rail 10 and the side gate projection 28*b* of the second side rail 12) via gravity, as shown in FIGS. 1 and 12. In some embodiments, the hinged gate 40 is rectangular in shape, although any suitable shape, such as square, oval, circular, etc., may be used. In some embodiments, the hinged gate 40 may be made from a single length of metallic tubing that is bent to form a one piece side hinged gate 40, to provide the added benefit of ease of manufacture, ease of assembly, structural strength, and no loosening of joint fittings. However, in yet other embodiments, the hinged gate 40 may be crafted from multiple pieces of tubing or other suitable material, fastened together, via bolts, welds, screws, or other suitable means. In yet other embodiments, the hinged gate 40 may comprise segments that may telescope fully or partially within adjacent segments, or utilize spacers between the segments, to allow for a gate having adjustable dimensions to accommodate the installation of the rail system 1 adjacent to portals 6 of various sizes. In some embodiments, the hinged gate 40 includes a recess or projection for mating with a projection or recess of one of the side gate projection 28*a* of the first side rail 10 and the side gate projection 28*b* of the second side rail 12 to form a hinge upon which the hinged gate 40 may swing outwardly from its resting position. In yet other embodiments, as illustrated in FIGS. 5 and 6, a hinge structure 42 may be used to interface the hinged gate 40 with of one of the side gate projection 28*a* of the first side rail 10 and the side gate projection 28*b* of the second side rail 12 to allow the hinged gate 40 to swing outwardly from its resting position. In yet other embodiments, as illustrated in FIGS. 2, 4, 5, and 6, a latch structure 44 may be used to latch the hinged gate 40 to of one or both of the side gate projection 28*a* of the first side rail 10 and the side gate projection 28*b* of the second side rail 12, which provides added security from the wind or users accidentally opening the hinged gate 40 at a time when opening of the hinged gate 40 is not intended. Such a latching mechanism may be a simple hook and loop, such as the gravity rocker latch illustrated in FIG. 2, magnetic, or other suitable latching means positioned in any of a variety of positions.

In yet other embodiments, as illustrated in FIG. 5, a biasing structure 46 may be used to bias the hinged gate 40 to a side gate projection 28 of the first side rail 10 or the second side rail 12, which, alone or in combination with gravity, causes the hinged gate 40 to rest in a closed position interfacing with the side gate projections 28 of the first side rail 10 and the second side rail 12. The biasing structure 46 may be a spring, piston, or any other suitable means for influencing the movement of the hinged gate 40. The use of a biasing structure 46 provides added security from the wind or users accidentally opening the hinged gate 40 at a time when opening of the hinged gate 40 is not intended. In other embodiments, the gravity operation of the gate functions by positioning the hinged gate 40 to rest adjacent to the side gate projection 28*a* of the first side rail 10 and the side gate projection 28*b* of the second side rail 12, at an angle from vertical, as measured by at least one plane passing through the hinged gate 40 and the open volume enclosed by it, which in the preferred embodiment is an acute angle from vertical as measured from the lowermost point of reference of the hinged gate 40 as the apex of the angle with vertical. This creates the situation where the hinged gate 40 swings outward from its interface with one of the side gate projection 28*a* of the first side rail 10 and the side gate projection 28*b* of the second side rail 12 at an angle offset from vertical, thereby, causing the hinged gate 40 to return to its resting position or closed position via the force applied by gravity to its mass. Such a gravity gate feature provides the added benefit of having the gate automatically close or biased to close when not in use, thereby eliminating or reducing the safety concern of a user forgetting to close the gate and risking a fall by a user therethrough. It should be noted that in other embodiments, the hinged gate 40 may interface directly with the side rails 10 and 12 or any portion of the side rails 10 and 12 as opposed to the side gate projections 28*a* and 28*b*. In yet other embodiments, the hinged gate 40 is restricted, via the hinge, side gate projections, or other mechanical block, from opening in an inward direction towards the area formed between the first side rail 10 and the second side rail 12 and/or substantially over the opening of the portal 6. In yet other embodiments, the hinged gate 40 is restricted, via the hinge, side gate projections, or other mechanical block, from opening in an outward direction past a point that would prohibit the return of the gate 40 to its resting or closed position via gravity.

Figure 21:
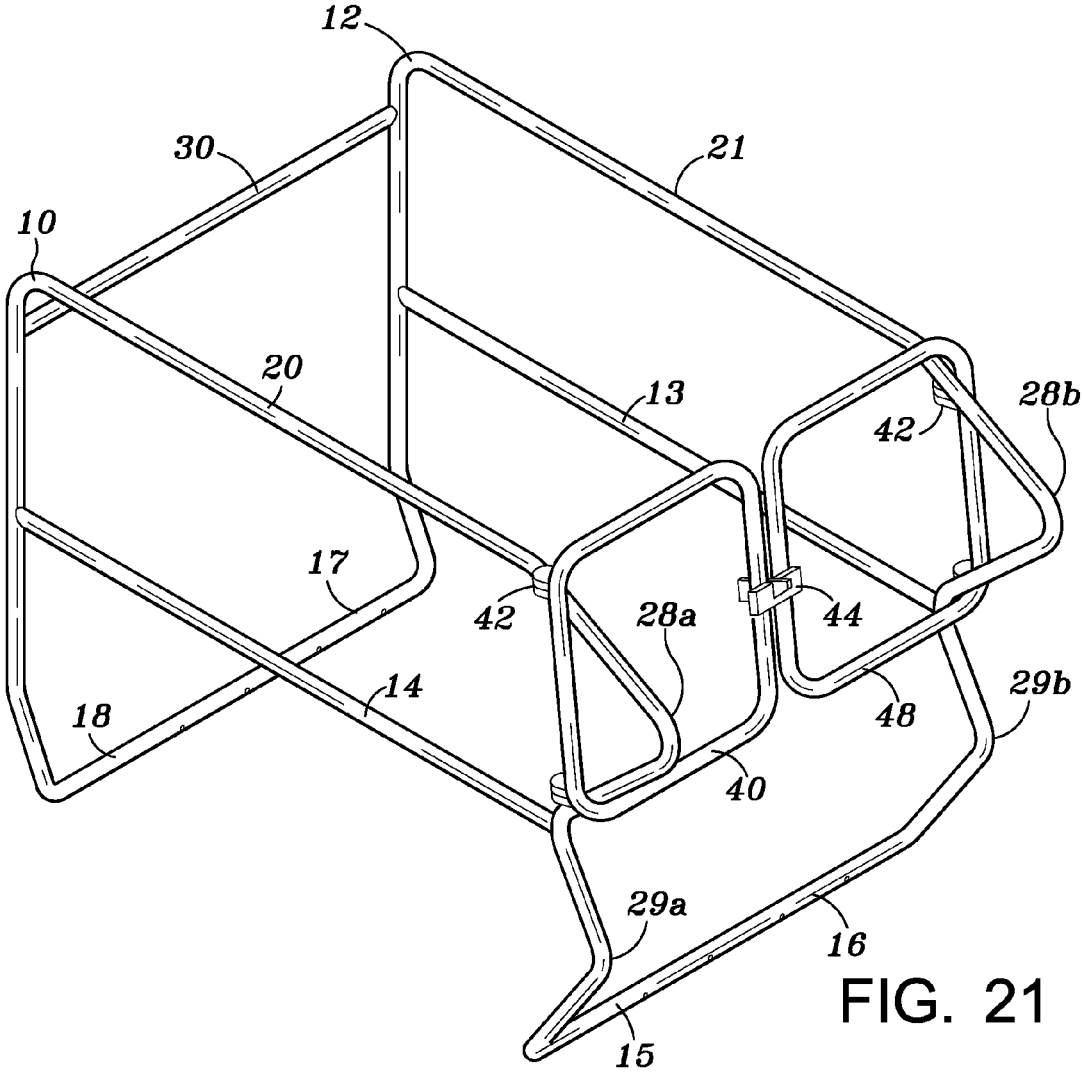
FIG. 21 is an isometric view showing one embodiment of the integrated safety rail protection system having a first and a second gate.
Figure 16:
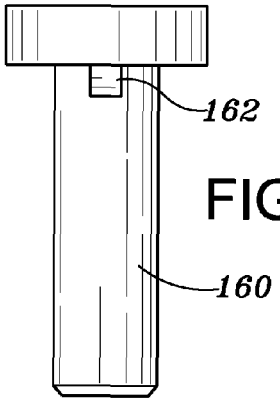
FIG. 16 is a front view of a hinge shaft of a pinchless hinge structure having a protrusion on the hinge shaft.
Figure 17:
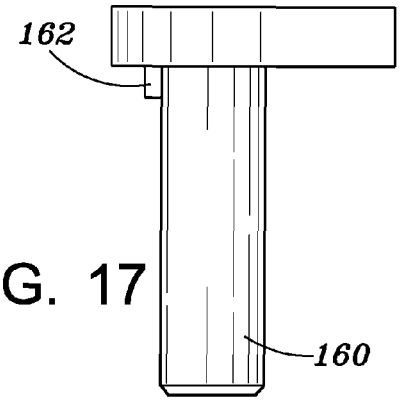
FIG. 17 is a side view of a hinge shaft of a pinchless hinge assembly having a protrusion on the hinge shaft.

Referring to FIGS. 13, 14, 15, 16, and 17, in yet other embodiments, the hinge structure 42 of FIGS. 5, 6, and 21 may be a pinchless hinge structure 140 that can be attached to the structures to be hinged by weld, bolt, or other means. The hinge structure 140 of these embodiments comprises a hinge housing 150, a hinge shaft 160, a hinge shaft protrusion 162, and a partial hinge housing recess 152 on one end of the housing 150. In operation, when the shaft is inserted into the pinchless hinge structure 140, the rotation of the shaft is impeded by the interface of the shaft protrusion 162 with the partial housing recess 152; however, by simply raising the shaft 160 in relation to the housing 150, the shaft protrusion 162 can be moved to clear the impediment of the partial housing recess 152, and thus, the shaft 160 can fully rotate within the housing 150. Other embodiments may further include a full 360 degree hinge housing recess 154 in one end of the housing 150 to allow for free rotation of the hinge shaft 160 despite the inclusion of a hinge shaft protrusion 162. In other embodiments, the hinge structure 140 can be opened and closed by an internal or external spring, torsion bar, or other powered device via a splined shaft/gear mechanism or other suitable means, as one of ordinary skill in the art would understand.

Figure 18:
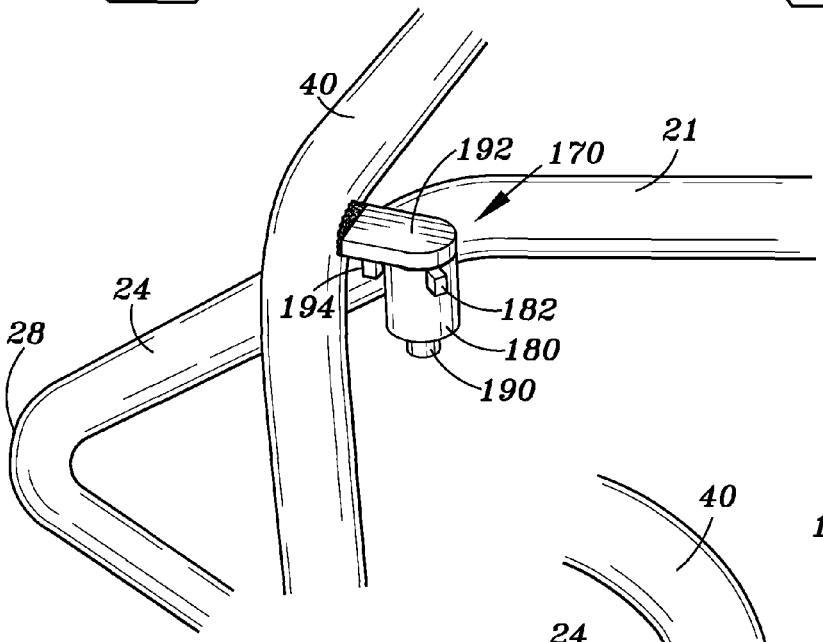
FIG. 18 is an isometric view of an external stop hinge structure interfacing a side rail and a gate in a manner where the external stop will engage to prevent further movement of the gate.
Figure 19:
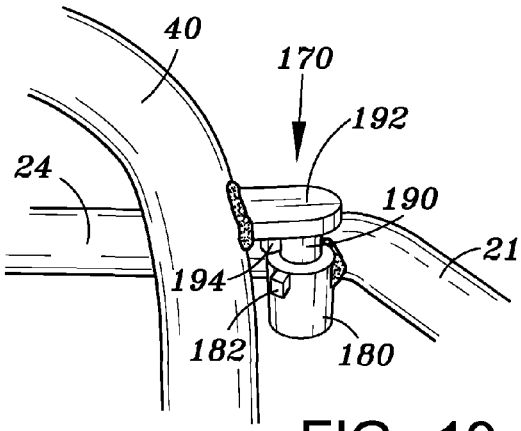
FIG. 19 is an isometric view of an external stop hinge structure interfacing a side rail and a gate in a manner where the hinge shaft has been raised to allow the shaft to freely rotate.
Figure 20:
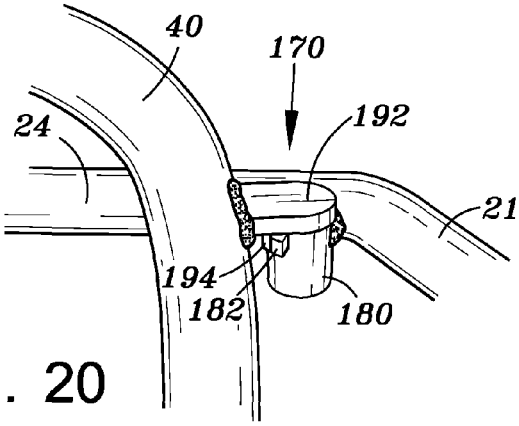
FIG. 20 is an isometric view of an external stop hinge structure interfacing a side rail and a gate in a manner where the external stop is engaged.

Referring to FIGS. 18, 19, and 20, in yet other embodiments, the hinge structure 42 may be an external stop hinge structure 170 that can be attached to the structures to be hinged by weld, bolt, or other means. The hinge structure 170 of these embodiments comprises a hinge housing 180, a hinge shaft 190, a hinge shaft cap 192, a housing protrusion 182, and a hinge cap protrusion 194. The hinge shaft 190 is attached to the hinge shaft cap 192, which has the hinge cap protrusion 194 attached thereto. The hinge shaft 190 is inserted into an opening formed within the hinge housing 180 for receiving the hinge shaft 190 for rotation. The hinge cap protrusion 194 interfaces with the housing protrusion 182, which is attached to the exterior of the hinge housing 180, said interface limits the degree of rotation of the hinge shaft 190 within the hinge housing 180. In other embodiments, the hinge shaft 190 may be raised in elevation relative to the hinge housing 180, thereby eliminating any interference between the hinge cap protrusion 194 and the hinge housing protrusion 182, which allows for full 360 degree rotation of the hinge shaft 190 within the hinge housing 180. In other embodiments, the hinge structure 170 can be opened and closed by an internal or external spring, torsion bar, or other powered device via a splined shaft/gear mechanism or other suitable means, as one of ordinary skill in the art would understand.

Referring to FIG. 21, in yet another embodiment, a second hinged gate 48 is included in the safety rail system 1. In this embodiment, the first hinged gate 40 interfaces with a first side gate projection 28*a*, although it may interface directly with any portion of the first side rail 10. As previously described, the interface between the hinged gate 40 and the first side gate projection 28*a* may include projections and recesses or a hinge structure 42 for a hinge-type mating between the hinged gate 40 and the first side gate projection 28*a*. Additionally, in some embodiments, as previously described, a biasing structure may be included to influence the movement of the hinged gate 40 and the hinged gate may be positioned at an acute angle from vertical to utilize the force of gravity for influencing the movement of the hinged gate 40. The first hinged gate 40 does not directly interface with the second side gate projection 28*b* or any portion of the second side rail 12; instead, the second hinged gate 48 is positioned, operates, and interfaces with the second side gate projection 28*b* or any portion of the second side rail 12 in a manner substantially similar to the position, operation, and interface between the first hinged gate 40 and the first side gate projection 28*a* or any portion of the first side rail 10. In operation of one embodiment, portions of the first hinged gate 40 and the second hinged gate 48 interface at a point between the first side gate projection 28*a* and the second side gate projection 28*b*, and may include a latching mechanism 44 operable to latch the first hinged gate 40 to the second hinged gate 48.

Referring again to FIG. 7, in one embodiment of the integrated safety rail protection system, the side rail 10 may include a combination side gate projection and hand-grip projection 50, comprising a first segment 24, extending downward at an angle less than 180 degrees from the top rail 20, and a second segment 25, extending downward from the first segment 24 to interface with the portal 6. In addition to the economic features of fewer bends in the railing system, some users find the straight lines ergonomically advantageous.

Figure 8:
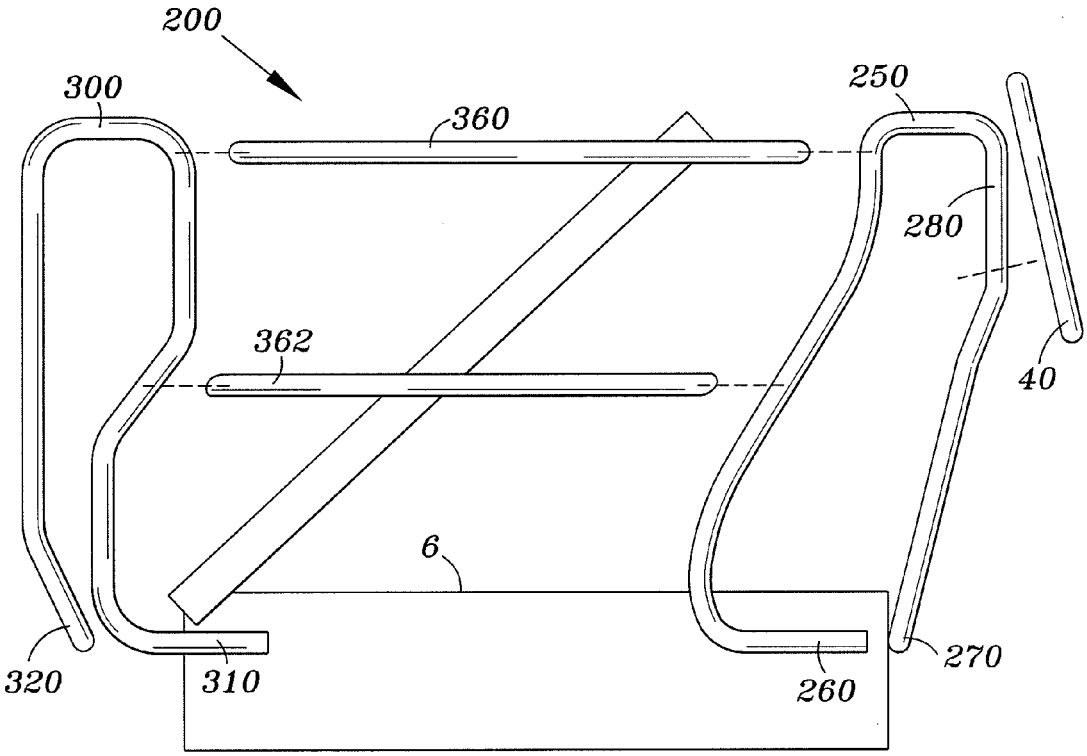
FIG. 8 is a partially exploded side view showing one embodiment of the integrated safety rail protection system utilizing corner rails.
Figure 9:
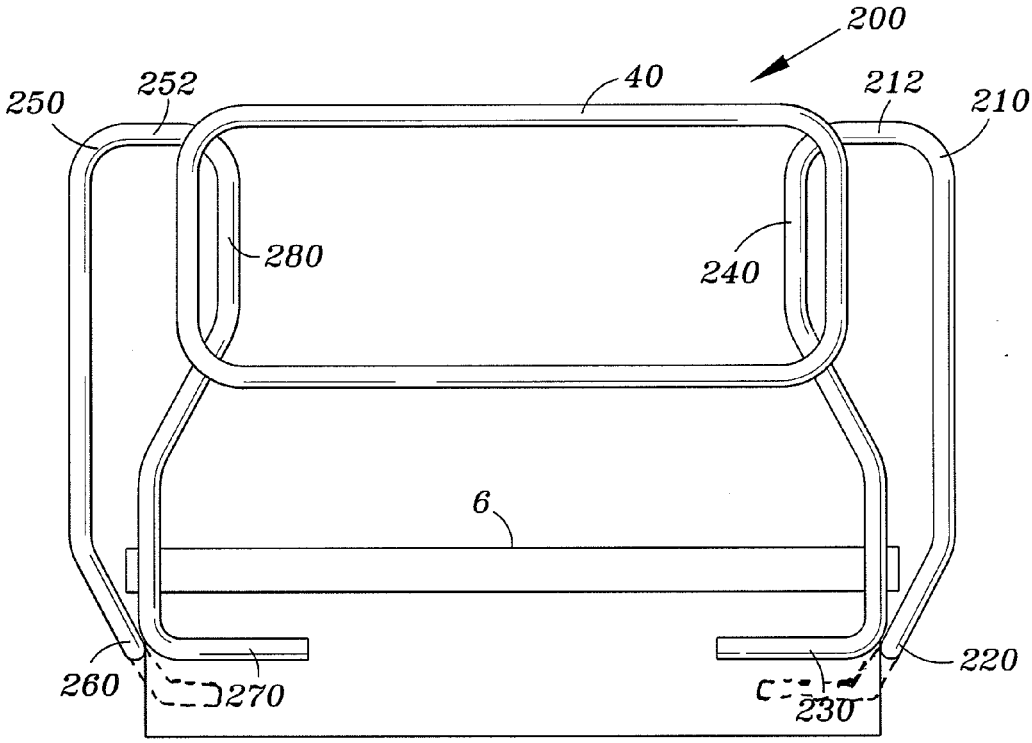
FIG. 9 is a front view showing embodiments of the integrated safety rail protection system of FIG. 8 utilizing corner rails.

Referring to FIGS. 8 and 9, in yet another embodiment, a corner rail system 200 is shown that may be positioned adjacent to a portal 6, and comprises a front left corner rail 210 with a first front left corner mounting projection 220, a second front left corner mounting projection 230, and a front left corner gate projection 240, wherein said first front left corner mounting projection 220 is positioned substantially perpendicular to said second front left corner mounting projection 230, and wherein said front left corner gate projection 240 interfaces with the hinged gate 40, for example where said front left corner gate projection 240 extends at least partially into the area enclosed by the gate 40. The corner rail system 200 further comprises a front right corner rail 250 with a first front right corner mounting projection 260, a second front right corner mounting projection 270, and a front right corner gate projection 280, wherein said first front right corner mounting projection 260 is positioned substantially perpendicular to said second front right corner mounting projection 270, and wherein said front right corner gate projection 280 extends at least partially into the area enclosed by the gate 40. The hinged gate 40 operates in the same fashion as described above in reference to the side rail system 1. In some embodiments, the front left corner rail 210 and the front right corner rail 250 may each have a generally horizontal top rail (212 and 252, respectively) for an ergonomic grab hold. In yet other embodiments, the front left corner gate projection 240 may extend from the top rail 212, and the front right corner gate projection 280 may extend from the top rail 252. The remaining structure associated with the front left corner rail 210 and the front right corner rail 250 may take on various forms, including, as described above in reference to the side rail system 1, straight structures and angled structures that provide ergonomic or desired grab holds or hand-grips. In some embodiments, as with the side rail 10 of the rail system 1, the front left corner rail 210 and the front right corner rail 250 can each be formed from a continuous tube of metal, although other materials, such as fiberglass, composite, carbon fiber, etc., may also be used. The benefit of using a continuous tube or other continuous structure is its strength and rigidity as well as ease of manufacture. In yet other embodiments, as with the side rail 10 of the rail system 1, the front left corner rail 210 and the front right corner rail 250 can each be formed from segments of metal tubing or other suitable materials, such as fiberglass, composite, carbon fiber, etc., that fastened together by screws, bolts, welds, or other suitable fastening means.

Referring again to FIG. 8, in yet other embodiments of the corner rail system 200, the system 200 may further comprise a back right corner rail 300 with a first back right corner mounting projection 310 and a second back right corner mounting projection 320, wherein said first back right corner mounting projection 310 is positioned substantially perpendicular to said second back right corner mounting projection 320. In yet other embodiments, a back left corner rail 350 (not illustrated) may be used that operates in the substantially same manner as the back right corner rail 300 as described above.

In yet another embodiment, a back rail member 352 (not illustrated), such as a metal tube or other structure of suitable size, shape and material, is mounted between the back right corner rail 300 and the back left corner rail 350 (not illustrated) for enhanced stability between the two corner rails, and to provide yet another grab hold or hand grip for the user. Because the corner rail system 200 may accommodate portals of various lengths and widths, in a kit or retrofit form, the back rail member may be supplied in a manner to be cut down to desired length for installation of the portal at issue.

Referring again to FIG. 8, in yet another embodiment, a cross rail member 360 may be mounted between the front right corner rail 250 and the back right corner rail 300 for enhanced stability between the two corner rails, to lessen the risk of a user falling between the rails, and to provide yet another grab hold or hand grip for the user. In yet another embodiment, a cross rail member 360 may be mounted between the front left corner rail 210 and the back left corner rail 350 in the same fashion and with the same benefits as previously described. Because the corner rail system 200 may accommodate portals of various lengths and widths, in a kit or retrofit form, the cross rail member may be supplied in a manner to be cut down to desired length for installation of the portal at issue.

In yet another embodiment, the corner rail system 200 may include a single corner rail 210 for mounting adjacent to a portal 6. Such a single corner rail system may be used where multiple corner rail systems are cost prohibitive, but at least some ergonomic and sturdy grab holds or hand-grips are desired.

Referring again to FIGS. 8 and 9, by having the mounting projections, for example mounting projections 260 and 270, of the corner rails (front or back) at substantially right angles to one another, easy mounting (via screws, bolts, welds, or other suitable fastening means) of the corner rails adjacent to a portal 6 may occur, since many portals have 90-degree corners that easily, or with minimal adjustment, match up to the substantially perpendicular mounting projections. An additional benefit of substantially perpendicular mounting projections is that the respective corner rail may have enhanced stability, when mounted, against forces acting on the corner rail from all sides. If the mounting area adjacent to the portal 6 does not have a ninety degree corner, the mounting projections may be adjusted, by bending, use of spacers, or otherwise, to accommodate the shape of the portal 6. Additionally, in some embodiments, a mounting structure 120, as described above and referred to in FIG. 10, may be used to fasten a mounting projection, for example mounting projections 260 or 270, to the portal 6, for ease of mounting installation, adjustability in mounting the corner rails (210, 250, 300, 350) adjacent to portals 6 of various sizes, and strength of the mount due to increased surface area on the mounting projection. Absent use of a mounting structure 120, the mounting projections are directly mounted adjacent to the portal 6 using screws, bolts, welds, or other suitable fastening means.

In yet other embodiments, a corner rail 210 (or any corner rail, including 250, 300, and 350) may have only one mounting projection for mounting (via a mounting structure 120 or by screws, bolts, welds, or other suitable fastening means) to any side or portion of the portal 6 where the position of the corner rail 210 is desired. Referring again to FIGS. 8 and 9, in yet other embodiments, a corner rail 210 (or any corner rail, including 250, 300, and 350) may have a first mounting projection 220 and a second mounting projection 230, where such mounting projections are parallel or substantially parallel to each other (as illustrated, for example, by the dashed lines of FIG. 9) for ease of mounting and strength of the mount to any side, or front portion of the portal 6 where the position of the corner rail 210 is desired.

In yet another embodiment, the corner rail system 200 may be provided in kit form for retrofitting existing portals, such as roof openings, manholes, skylights, etc., wherein the kit may include a front left corner rail 210, a front right corner rail 250, and a hinged gate 40. As described above, the hinged gate 40 may be adjustable in dimensions, with spacer segments, telescoping segments, etc., to accommodate varied widths of portals 6. Such a system would provide substantial protection from a user falling during ingress or egress through the portal 6, especially in light of the various shapes and angles of the grab holds or hand-grips. In yet another embodiment, the kit may include a back right corner rail 300 and/or a back left corner rail 350 to provide additional safety from a user falling during ingress or egress through the portal 6. In yet other embodiments, the kit may include a back rail 352 for providing additional barriers between the corner rails to provide additional safety from a user falling during ingress or egress through the portal 6. In yet other embodiments, the kit may include a top rail 360 for providing additional barriers between the corner rails to provide additional safety from a user falling during ingress or egress through the portal 6. In yet other embodiments, the kit may include a cross rail 362 for providing additional barriers between the corner rails to provide additional safety from a user falling during ingress or egress through the portal 6. In yet other embodiments, the kit may include one or more mounting structures 120 and/or mounting hardware, such as screws, bolts, etc.

It should be noted that the elements making up any chosen embodiment of the invention described herein may be made of metal, ceramics, plastics, carbon fiber, fiberglass, wood, and other materials with suitable properties. Additionally, all or selected portions of surfaces of the safety rail system 10 may be knurled for grip, which includes surface texturing, surface projections, textured paint or powder coating, textured grip tape, or any other method of surface texturing to aid in gripping by a user's hands or feet.

Although embodiments of the integrated safety rail protection system have been described in detail, those skilled in the art will also recognize that various substitutions and modifications may be made without departing from the scope and spirit of the appended claims.

What is claimed is:

1. A safety rail protection system adaptable to be positioned adjacent to a portal to aid in at least one of ingress and egress through the portal, the safety rail protection system comprising:

a hinged gate having an opening operable to open outwardly;

a first side rail, wherein the first side rail includes a first side gate projection extending at least partially into the hinged gate opening, and a first side hand-grip projection operable to provide a first gripping surface to aid in at least one of ingress and egress through the portal; and a second side rail, wherein the second side rail includes a second side gate projection extending at least partially into the hinged gate opening, and a second side hand-grip projection operable to provide a second gripping surface to aid in at least one of ingress and egress through the portal.

2. The safety rail protection system of claim 1, further comprising a back rail member positioned substantially between the first side rail and the second side rail.

3. The safety rail protection system of claim 1, wherein the hinged gate couples with the first side gate projection at an interface.

4. The safety rail protection system of claim 3, further comprising a hinge structure positioned adjacent to the interface of the hinged gate and the first side gate projection.

5. The safety rail protection system of claim 3, further comprising a biasing structure positioned adjacent to the interface of the hinged gate and the first side gate projection.

6. The safety rail protection system of claim 4, wherein the hinge structure comprises a hinge housing having a generally cylindrical shaft opening with at least one recess, and a generally cylindrical hinge shaft having at least one protrusion, wherein at least a portion of said shaft is positioned within said shaft opening, and wherein said protrusion interfaces with said recess to limit the rotation of the shaft within the hinge housing.

7. The safety rail protection system of claim 5, where the biasing structure is a coil spring.

8. The safety rail protection system of claim 1, wherein the hinged gate couples with the second side gate projection at an interface.

9. The safety rail protection system of claim 8, wherein the interface comprises a latching structure positioned adjacent the hinged gate and the second side gate projection.

10. The safety rail protection system of claim 9, wherein the latching structure is a gravity rocker latch.

11. The safety rail protection system of claim 1, wherein the first side hand-grip projection comprises a first segment extending at a first angle from the first side gate projection, and a second segment extending at a second angle from the first segment of the first side hand-grip projection.

12. The safety rail protection system of claim 1, wherein the second side hand-grip projection comprises a first segment extending at a first angle from the second side gate projection, and a second segment extending at a second angle from the first segment of the second side hand-grip projection.

13. The safety rail protection system of claim 1, wherein the railing system is at least partially knurled.

14. The safety rail protection system of claim 1, wherein the first side rail and the second side rail each further comprise a cross rail member.

15. The safety rail protection system of claim 1, wherein the first side rail and the second side rail each are formed from a continuous tube.

16. The safety rail protection system of claim 1, wherein said hinged gate has an open position and a closed position, wherein in said closed position the hinged gate interfaces with the first side gate projection and the second side gate projection, wherein in said open position the hinged gate interfaces with only one of the first side gate projection and the second side gate projection, and whereupon releasing the hinged gate from said open position, it returns, via gravity, to said closed position.

17. The safety rail protection system of claim 16, wherein said hinged gate is adaptable to be fixed in the open position.

18. The safety rail protection system of claim 1, wherein the hinged gate is formed from a single continuous tube.

19. The safety rail protection system of claim 1, wherein the first side rail further comprises a front mounting projection and a rear mounting projection.

20. The safety rail protection system of claim 19, wherein at least one of the front mounting projection and the rear mounting projection extends substantially perpendicular to the first side rail in at least one plane.

21. The safety rail protection system of claim 19, further comprising a mounting structure, for attachment adjacent to the portal, having an opening for receiving at least one of a portion of the front mounting projection and the rear mounting projection.

22. The safety rail protection system of claim 21, wherein the mounting structure is a generally hollow tube.

23. The safety rail protection system of claim 19, wherein at least one of the front mounting projection and the rear mounting projection are mounted adjacent to the portal using a fastener.

24. The safety rail protection system of claim 1, wherein the second side rail further comprises a front mounting projection and a rear mounting projection.

25. The safety rail protection system of claim 24, wherein at least one of the front mounting projection and the rear mounting projection extends substantially perpendicular to the second side rail in at least one plane.

26. The safety rail protection system of claim 24, further comprising a mounting structure, for attachment adjacent to the portal, having an opening for receiving at least one of a portion of the front mounting projection and the rear mounting projection.

27. The safety rail protection system of claim 26, wherein the mounting structure is a generally hollow tube.

28. The safety rail protection system of claim 24, wherein at least one of the front mounting projection and the rear mounting projection are mounted adjacent to the portal using a fastener.

29. The safety rail protection system of claim 1, wherein the hinged gate is not operable to open inwardly into a volume formed between the first side rail and the second side rail.

30. The safety rail protection system of claim 1, wherein a primary plane of said hinged gate is positioned at an acute angle from vertical.

31. The safety rail protection system of claim 30, wherein said hinged gate operates at least partially using gravity.

32. The safety rail protection system of claim 1, wherein said hinged gate does not open past a set distance from a closed resting position of said hinged gate.

* * * * *